United States Patent [19]

Eichinger

[11] 3,939,807

[45] Feb. 24, 1976

[54] ENGINE TEMPERATURE CONTROL SYSTEM

[75] Inventor: Charles H. Eichinger, Oshkosh, Wis.

[73] Assignee: Outboard Marine Corporation, Waukegan, Ill.

[22] Filed: Nov. 25, 1974

[21] Appl. No.: 526,899

Related U.S. Application Data

[63] Continuation of Ser. No. 384,063, July 30, 1973, abandoned.

[52] U.S. Cl. ..... 123/41.08; 123/41.02; 123/41.05; 123/41.29; 123/41.72; 236/34.5

[51] Int. Cl.[2] ..... F01P 7/14

[58] Field of Search..... 123/41.08, 41.02, 41.05, 123/41.29, 41.72; 236/101 C, 34.5

[56] References Cited

UNITED STATES PATENTS

| | | | |
|---|---|---|---|
| 1,774,881 | 9/1930 | Fry | 123/41.72 |
| 1,848,987 | 3/1932 | Anibal | 123/41.72 |
| 2,633,834 | 4/1953 | Kiekhaeffer | 123/41.08 |
| 2,741,231 | 4/1956 | Watkins | 123/41.08 |
| 3,105,472 | 10/1963 | Jasper | 123/41.08 |
| 3,358,654 | 12/1967 | Shanahan | 123/41.29 |
| 3,667,431 | 6/1972 | Kueny | 123/41.08 |

*Primary Examiner*—Charles J. Myhre
*Assistant Examiner*—Daniel J. O'Connor
*Attorney, Agent, or Firm*—Michael, Best & Friedrich

[57] ABSTRACT

Disclosed herein is an internal combustion engine including a cooling system having a first coolant jacket portion for cooling the engine in the vicinity of the engine cylinder and a second coolant jacket portion from which the coolant is discharged. Flow of coolant from the first coolant jacket portion to the second coolant jacket portion is selectively controlled by a thermostatic valve which includes a temperature responsive element which is mounted in heat exchanging relationship with an engine block member at least partially defining a cylinder and which is operable to afford coolant flow from the first coolant jacket portion to the second coolant jacket portion when the temperature of the block member is above a predetermined level.

14 Claims, 4 Drawing Figures

Fig. 2
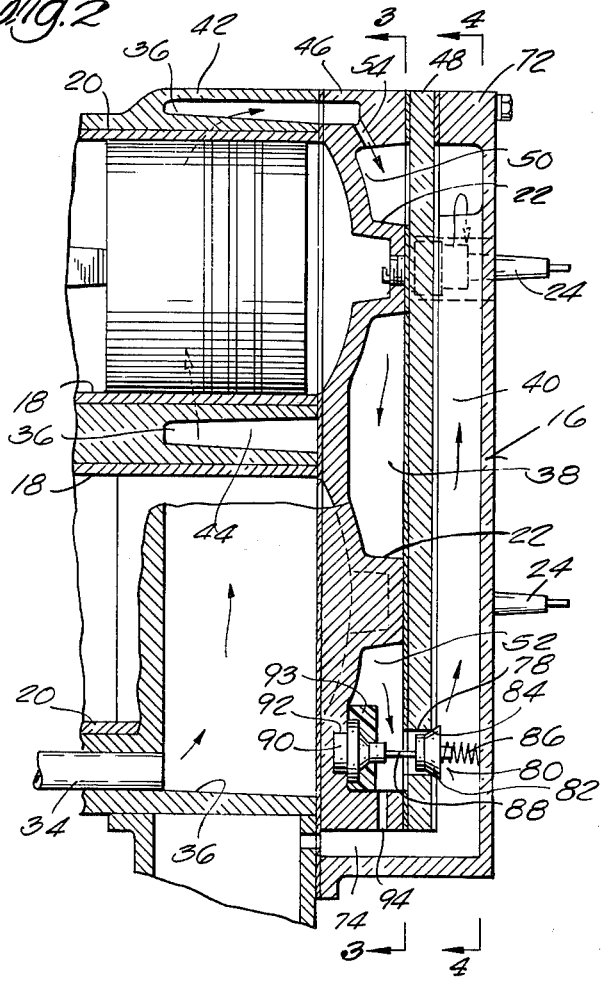
Fig. 3
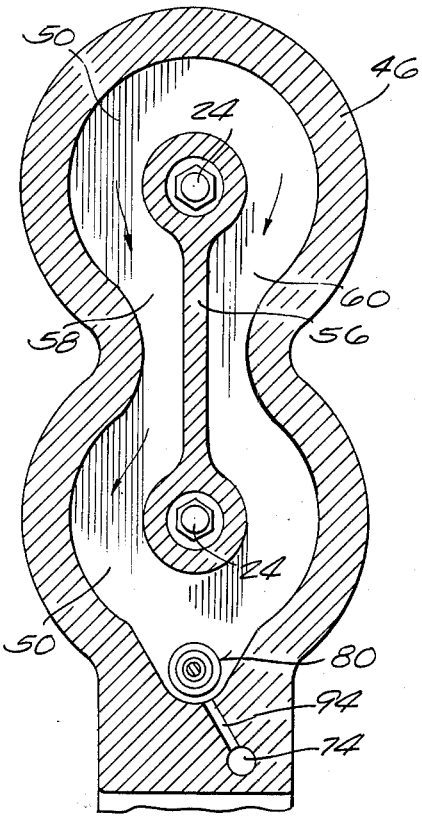
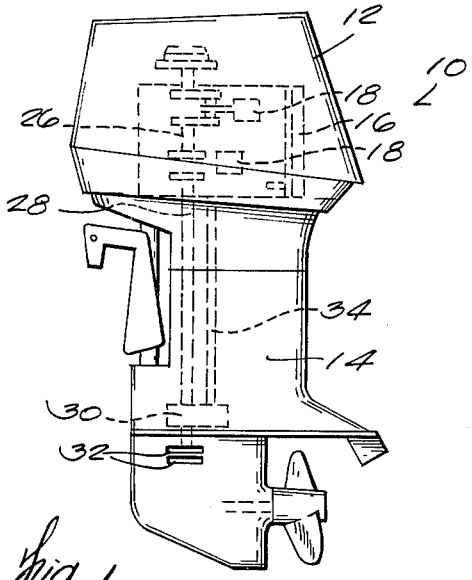
Fig. 1
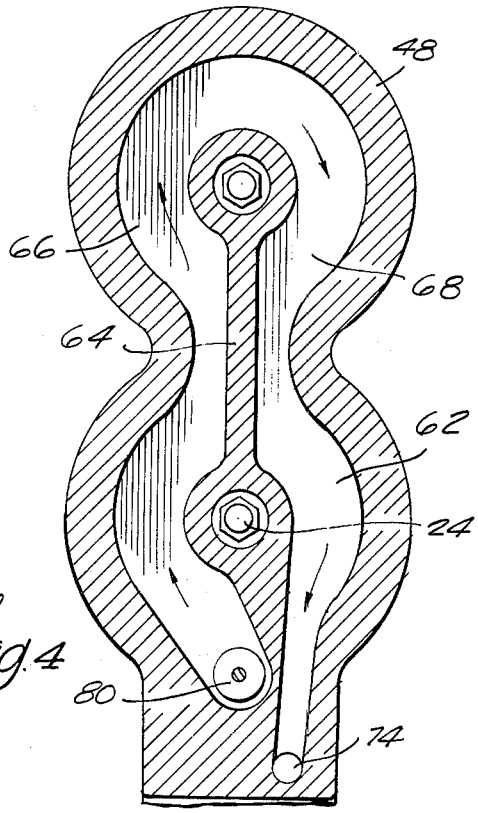
Fig. 4

ENGINE TEMPERATURE CONTROL SYSTEM

This application is a continuation of my application Ser. No. 384,063 filed July 30, 1973.

BACKGROUND OF THE INVENTION

This invention relates to the cooling of internal combustion engines and, more particularly, to the cooling of marine engines.

In the past, various types of cooling systems have been employed for marine engines, including, for example, systems which merely pump coolant in an uncontrolled manner through engine cooling passages, so-called blocking systems which employ a thermostatic valve for blocking coolant flow through the engine cooling passages until the coolant has reached a predetermined level, and recirculating systems which recirculate the coolant through engine cooling passages until the predetermined coolant temperature is reached, after which some of the warm coolant overflows and sufficient make-up coolant is introduced to maintain the coolant at the predetermined temperature.

For optimum engine performance under idling speed conditions, it is desirable for the areas of the engine in the vicinity of the cylinders to be relatively warm. This condition assists in maintaining smooth engine operation and preventing spark plug fouling, which is particularly advantageous for two-cycle engines employing a fuel containing a lubricating oil. Under high speed conditions, optimum engine performance is obtained by maintaining the cylinders as cool as possible. Although providing satisfactory cooling at some engine speeds, the above-described cooling systems do not provide optimum cooling throughout the entire range of engine speeds.

U. S. Kueny et al U.S. Pat. No. 3,667,431, issued June 6, 1972, describes an improved cooling system having separate coolant jacket portions. The primary flow of coolant from one coolant jacket portion to the other is selectively controlled by thermostatic valve and/or pressure relief valve. The thermostatic valve prevents coolant flow until the temperature of the coolant in the first coolant jacket portion has reached a predetermined level and, if used, the pressure relief valve opens to afford coolant flow when the pressure of the coolant in the first coolant jacket portion reaches a predetermined level.

SUMMARY OF THE INVENTION

This invention provides an internal combustion engine cooling system having first and second coolant jacket portions. The first coolant jacket portion is connected to a coolant supply pump and the second coolant jacket portion is connected to a conduit for discharging the coolant, either overboard or for recirculation. The flow of coolant from the first coolant jacket portion to the second coolant jacket portion is selectively controlled by a normally closed valve including means for opening the valve when the temperature of an engine block member at least partially defining an engine cylinder is above a predetermined temperature and for preventing the valve from opening when the temperature of the block member is below the predetermined temperature. More specifically, such means comprises a temperature responsive element which is mounted in heat exchanging relationship with the engine block member, such as in a recess provided in the block member adjacent to a cylinder, and which is operable to open the valve when the temperature of the block member is above a predetermined level.

Also, in accordance with the invention, a spring can be provided for maintaining the valve in a closed position until the engine block member temperature is above the predetermined level, irrespective of the temperature of the coolant and irrespective of the pressure of the coolant being supplied to the first coolant jacket portion by the pump.

With this arrangement, the area of the engine in the vicinity of the cylinder is maintained at a predetermined temperature more representative of that desired for optimum engine operation at lower engine speeds and adequate coolant flow is provided at higher engine speeds.

One of the objects of the invention is to provide an improved cooling system for an internal combustion engine and, particularly for a two-cycle outboard motor internal combustion engine.

Another object of the invention is to provide an internal combustion engine having a cooling system wherein the flow of coolant through the cooling system is controlled primarily in response to the metal temperature of an engine block member.

Other objects, aspects and advantages of the invention will become apparent upon reviewing the following detailed description, the drawing and the appended claims.

BRIEF DESCRIPTION OF THE DRAWINGS

FIG. 1 is a partially diagrammatic view of an outboard motor in accordance with the invention.

FIG. 2 is a fragmentary, sectional view, partially broken away, of the engine incorporated in the outboard motor shown in FIG. 1.

FIG. 3 is a sectional view taken along the plane designated 3—3 in FIG. 2.

FIG. 4 is a sectional view taken along the plane designated 4—4 in FIG. 2.

DESCRIPTION OF THE PREFERRED EMBODIMENTS

Before explaining the invention in detail, it is to be understood that the invention is not limited in its application to the details of construction and the arrangement of the components set forth in the following description or illustrated in the drawing. The invention is capable of other embodiments and of being practiced and carried out in various ways. Also, it is to be understood that the phraseology and terminology employed herein is for the purposes of description and should not be regarded as limiting.

Shown in FIG. 1 is an outboard motor 10 embodying various features of the invention. The outboard motor includes a power unit 12 mounted on top of a lower unit 14. The power unit 12 includes an internal combustion engine 16 having two cylinders 18, each including a cylindrical portion 20 and a head portion 22 having a spark plug 24 mounted therein. The power unit 12 also includes a crankshaft 26 which is connected to a drive shaft 28 in the lower unit 14. The drive shaft 28 is connected to and drives a water or coolant pump 30 which communicates through a suitable inlet 32 with the water from a lake or stream in which the boat mounted outboard motor 10 is operating. The pump 30 is capable of providing an increasing volume of water as the engine speed is increased and discharges water through a conduit 34 into an engine cooling water jacket 36 located in surrounding relation to the cylinders 18.

While various arrangements can be used, in the construction illustrated, the coolant jacket 36 is divided into a first portion 38 which is arranged to primarily cool the engine in the vicinity of and surrounding the cylinders 18 and a second portion 40 which is arranged to primarily cool the engine in the vicinity of the head portion 22 of the cylinders. In the construction illustrated, the main engine block member 42 defines a major part of the cylindrical portion 20 of each of the cylinders. A first or main section 44 of the first coolant jacket portion 38 is formed integrally into the main engine block member 42 in surrounding relation to each cylindrical portion 20 and is in communication at the bottom thereof with the pump supply conduit 34.

Attachably connected to the main engine block member 42 is an intermediate engine block member 46 which includes walls defining the head portion 22 of each cylinder. Detachably connected to the top of the intermediate block member 46 is a cylinder head cover member 48 which cooperates with a recess 50 provided in the top surface of the intermediate block member 46 to define another section 52 of the first coolant jacket portion 38.

In order to afford coolant flow from the section 44 into the section 52 of the first coolant jacket portion 38 and thereby insure flow generally throughout the first coolant jacket portion, a passage 54 communicating with both sections is provided in the intermediate engine block member 46 at a location remote from the pump supply conduit 34. As shown in FIGS. 2 and 3, the recess 50 in the top surface of the intermediate engine block member 46 is divided by a vertically extending partition 56 into two sections 58 and 60 which communicate with each other and with the passage 54. Recess 50 covers a large portion of the cylinder heads 22 to thereby provide an effective coolant jacket therefor.

Formed in the top surface of the cylinder head cover member 48 is an open recess 62 which, in part, forms the second coolant jacket portion 40. As shown in FIG. 4, the recess 62 is divided by a vertically extending partition 64 into two sections 66 and 68 which communicate with each other. Attached to the top of the cylinder head cover member 48 is a cap member 72 which cooperates with the cylinder head cover 48 to complete the second coolant jacket portion 40.

The cylinder head cover member 48 includes a discharge passage or an outlet 74 which communicates, at one end, with the section 68 of the second coolant jacket portion 40 and through which the coolant is freely discharged from the coolant jacket. The discharge outlet 74 can be arranged to pass the discharging coolant in heat exchanging relationship with the engine exhaust components (not shown) for cooling, prior to being returned to the lake or stream.

In accordance with the invention, coolant flow from the first coolant jacket portion 38 to the second coolant jacket portion 40 is selectively controlled by means which is operated in response to the temperature of an engine block member. More specifically in accordance with the invention, a normally closed valve connects the first coolant jacket portion 38 and the second coolant jacket portion 40 and means are provided for opening the valve, when the temperature of the intermediate engine block 46 is above a predetermined level, and for preventing the valve from opening, when the temperature of the intermediate engine block 46 is below the predetermined level.

While various arrangements can be used, in the construction illustrated, the cylinder head cover member 48 is provided with a port 78 for receiving a thermostatic valve assembly 80 including a valve member 82 which is urged into sealing engagement with a valve seat 84 surrounding the port 78 by a spring 86 which at one end bears against the cap member 72. The spring 86 is designed to maintain the valve member 82 in a closed position irrespective of the coolant pressure in the first coolant jacket portion 38, i.e., maintains the valve member 82 in a closed position even at the maximum coolant pressure provided by the pump 30 when the engine 10 is operating at full speed. The engine valve member is operably connected, via a push rod 88, to a temperature responsive element 90 which is mounted in a recess 92 provided in the intermediate block member 46 generally adjacent to the cylinder head portion 22 of one of the cylinders 18.

The temperature responsive element 90 is mounted in heat exchanging relationship with the metal surrounding the recess 92 and is suitably arranged so that, when the temperature of this metal reaches a predetermined level, the temperature responsive element 90 moves the push rod 88 upwardly to overcome the biasing force of the spring 86, and thereby moves the valve member 82 to an open position. The predetermined temperature corresponds to the temperature of the cylinder head portion 22 which provides smooth engine operation and assists in preventing spark plug fouling under idling speed conditions. For example, this temperature can be about 140°F.

Thus, once the metal temperature of the intermediate engine block member 46 reaches the predetermined level, the temperature responsive element 90 opens the valve member 82 to permit coolant flow from the first coolant jacket portion 38 into the second coolant jacket portion 40. With this arrangement, the primary flow of coolant is controlled in response to the cylinder head portion metal temperature which is more representative of the actual temperature desired inside the engine cylinder for smooth operation than the temperature of the coolant. If desired, the temperature responsive element 90 can be arranged so that the valve member 82 is variably opened as may be required to obtain sufficient flow of coolant to minimize metal temperature above the predetermined level.

The temperature responsive element 90 can fit loosely in the recess 92 and be sealed therein with a suitable sealing compound. However, in order to minimize the response time between the time when the intermediate engine block member 46 reaches the predetermined temperature and the time when the valve member 82 opens, the temperature responsive element 90 preferably fits snugly in the recess 92 and is in intimate contact with the surrounding metal. In order to reduce the effect of the water temperature on those portions of the thermostatic valve exposed to the water, it is preferable to incapsulate the exposed portions of the thermostatic valve as much as possible with an insulating material 93, such as an insulating plastic material. Thus, the effect of the water temperature on the operation of the thermostatic valve is minimized and it will more accurately respond to the engine block temperature as compared to the water temperature.

Details of the construction of the thermostatic valve assembly 80 and the means for securing the temperature responsive element 90 in the recess 92 are not part of the invention. For instance, the thermostatic valve assembly 80 generally can be the same type as that commonly used in engine cooling systems, but which is adapted so that the temperature responsive element thereof is mounted in heat exchanging relationship with the cylinder head portion metal as described above.

In order to provide a continuous, restricted flow of coolant from the first coolant jacket portion 38 whenever the pump 30 is operating, a by-pass conduit or passage 94 extending directly from the first coolant jacket portion 38 into the discharge outlet 74 can be provided in accordance with a preferred embodiment of the invention. Preferably, the by-pass passage 94 is dimensioned to accommodate a coolant flow approximating the flow provided by the pump at the engine idling speed, e.g., about 600 RPM. Alternately, the by-pass flow can be provided by a by-pass port (not shown) in the valve member 82.

In operation under idle speed conditions, the coolant supplied by the pump 30 travels through the first coolant jacket portion 38, and through the restricted bypass passage 94 if provided. Because of the relatively low rate of heat generation, the temperature of the intermediate engine block member 46 does not reach a level where the temperature responsive element 90 opens the valve member 82 and the spring 86 maintains the valve member 82 in a closed position. However, the heat generated is sufficient to increase the temperature of the coolant in the first coolant jacket portion 38 to a relatively hot level desired for promoting good engine performance at idling speeds. Also, since there is no coolant flow through the second coolant jacket portion 40, the upper portion of the cylinder head 22 become relatively hot, thereby further assisting in maintaining smooth engine operation and preventing spark plug fouling.

As the engine speed is increased above idling, the additional generated heat increases the temperature of the intermediate engine block member 46 above the predetermined level and the temperature responsive element 90 opens the valve member 82 as described above, permitting flow of coolant through the port 78. As a result, a relatively high volume flow of relatively cool coolant is thereafter provided by the pump 30 (which also is operating at a higher speed) through both the first coolant jacket portion 38 and the second coolant jacket portion 40. The increased cooling provided by the coolant restricts or diminishes elevation of the engine temperature above the predetermined temperature.

Since the cooling system of the invention does not employ a pressure relief valve, but instead employs a single valve means which is operated in response to the engine block temperature, the relatively large pressure drop associated with the use of a pressure relief valve is eliminated, thereby allowing much higher coolant flow, and thus better cooling, at high engine speeds. Also, the coolant in the first coolant jacket portion 38 must reach a relatively high temperature before a high volume flow of coolant is initiated, even though the engine is operating at high speeds, thereby insuring that the engine becomes sufficiently warm to obtain optimum performance.

Although the cooling system has been described for a two cylinder engine, it is to be understood that this system can be used in a single cylinder engine, as well as multi-cylinder engines.

Various of the features are set forth in the following claims.

I claim:

1. An internal combustion engine comprising an engine block member including wall means at least partially defining an engine cylinder, and a cooling system including a coolant jacket having a first portion for cooling a first part of said engine and a second portion for cooling a second part of said engine, means for supplying coolant to said first coolant jacket portion, a discharge conduit connected to said second coolant jacket portion for discharging coolant from said second coolant jacket portion, a normally closed valve connecting said first and second coolant jacket portions, and means including a temperature responsive element in direct contact with said block member and operably connected to said valve for opening said valve to afford flow of the coolant from said first coolant jacket portion to said second coolant jacket portion when the temperature of said engine block member is above a predetermined level, and means for preventing said valve from opening when the temperature of said engine block member is below said predetermined level.

2. An internal combustion engine according to claim 1 wherein said coolant supply means comprises an engine driven pump, and wherein said means for preventing opening of said valve includes a spring for maintaining said valve in a closed position irrespective of the coolant flow supplied to said first coolant jacket portion by said pump, so long as the temperature of said engine block member is below said predetermined level.

3. An internal combustion engine according to claim 1 wherein said predetermined temperature is about 140°F.

4. An internal combustion engine according to claim 1 including a by-pass means for affording restricted coolant flow between said first coolant jacket portion and said discharge conduit.

5. An internal combustion engine according to claim 1 including a recess in said engine block member adjacent to said wall means for receiving said temperature responsive element.

6. An internal combustion engine according to claim 1 wherein said engine cylinder includes a cylindrical portion and a head portion, wherein said first engine part includes the area in the vicinity of said cylindrical portion, and wherein said second part includes the area in the vicinity of said head portion.

7. An internal combustion engine according to claim 1 including a recess in said engine block member adjacent to said wall means for receiving said temperature responsive element.

8. An internal combustion engine according to claim 7 wherein said predetermined temperature is about 140°F.

9. An internal combustion engine comprising an engine block member including wall means at least partially defining an engine cylinder having a cylindrical portion and a head portion, an engine cooling system including a coolant jacket having a first portion for cooling a first part of said engine including the area in the vicinity of said cylindrical portion and having a second portion for cooling a second part of said engine including an area in the vicinity of said head portion, an engine driven pump for supplying coolant to said first coolant jacket portion, a discharge conduit connected to said second coolant jacket portion for discharging coolant from said second coolant jacket portion, a normally closed valve connecting said first and second coolant jacket portions, a temperature responsive element mounted in direct contact with said walls means and connected to said valve for opening thereof when the temperature of said engine block member adjacent to said wall means is above a predetermined level, and a spring for maintaining said valve in closed position irrespective of the coolant flow supplied to said first coolant jacket portion by said pump so long as the temperature of said engine block member is below said predetermined level.

10. An internal combustion engine comprising an engine block member including wall means at least partially defining an engine cylinder, and a cooling system including a coolant jacket, means for supplying coolant to said coolant jacket, a discharge conduit connected to said coolant jacket for discharging coolant from said coolant jacket, a normally closed valve connecting said coolant jacket and said discharge conduit, and means including a temperature responsive element in direct contact with said block member and operably connected to said valve for opening said valve to afford flow of the coolant from said coolant jacket portion to said discharge conduit when the temperature of said engine block member is above a predetermined level, and means for preventing said valve from opening when the temperature of said engine block member is below said predetermined level.

11. An internal combustion engine according to claim 10 wherein said predetermined temperature is about 140°F.

12. An internal combustion engine according to claim 10 including a by-pass means for affording restricted coolant flow between said first coolant jacket portion and said discharge conduit.

13. An internal combustion engine comprising an engine block member including wall means at least partially defining an engine cylinder, and an engine cooling system including a coolant jacket, an engine driven pump for supplying coolant to said coolant jacket, a discharge conduit connected to said coolant jacket for discharging coolant from said coolant jacket, a normally closed valve connecting said coolant jacket and said discharge conduit, a temperature responsive element mounted in direct contact with said wall means and connected to said valve for opening thereof when the temperature of said engine block member adjacent to said wall means is above a predetermined level, and a spring for maintaining said valve in closed position irrespective of the coolant flow supplied to said coolant jacket by said pump so long as the temperature of said engine block member is below said predetermined level.

14. An internal combustion engine according to claim 13 wherein said predetermined temperature is about 140°F.

* * * * *

PO-1050
(5/69)

UNITED STATES PATENT OFFICE
CERTIFICATE OF CORRECTION

Patent No. 3,939,807 Dated February 24, 1976

Inventor(s) Charles H. Eichinger

It is certified that error appears in the above-identified patent and that said Letters Patent are hereby corrected as shown below:

| | |
|---|---|
| Column 6, line 53 | delete "1", insert ---9---. |
| Column 7, line 6 | delete "walls means", insert ---wall means---. |

Signed and Sealed this

Twenty-first Day of September 1976

[SEAL]

*Attest:*

RUTH C. MASON
*Attesting Officer*

C. MARSHALL DANN
*Commissioner of Patents and Trademarks*